US007833020B1

(12) United States Patent
Ma et al.

(10) Patent No.: US 7,833,020 B1
(45) Date of Patent: Nov. 16, 2010

(54) ELECTRICAL CONNECTOR WITH LOW PROFILE TERMINAL

(75) Inventors: Hao-Yun Ma, Tu-Cheng (TW); David Gregory Howell, Chandler, AZ (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/456,277

(22) Filed: Jun. 15, 2009

(51) Int. Cl.
*H01R 12/00* (2006.01)

(52) U.S. Cl. ..... 439/66

(58) Field of Classification Search ..... 439/66, 439/65, 86, 71, 91, 591; 361/719, 86
See application file for complete search history.

(56) References Cited

U.S. PATENT DOCUMENTS 6,264,476 B1 * 7/2001 Li et al. ..... 439/66
6,471,525 B1 * 10/2002 Fan et al. ..... 439/70
2002/0098721 A1 * 7/2002 Fan et al. ..... 439/66
2006/0141815 A1 * 6/2006 Li ..... 439/66
2006/0189176 A1 * 8/2006 Li ..... 439/66
2006/0211276 A1 * 9/2006 Li ..... 439/66

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector 100 adapted for electrically connecting an IC package, comprises a base 1 and a plurality of terminals 2 received in the base 1. The base has a main body 10 defining a space for receiving the IC package and a plurality of passageways 101 extending vertically through two opposed sides of the main body 10. The terminal 2 comprises an insulated elastomer 21 acting as a resilient portion and a plurality of electrical elements 22 assembled on the insulated elastomer 21 acting as conductive portions to provide a plurality of electrical connecting paths for connecting the IC package.

16 Claims, 10 Drawing Sheets

ELECTRICAL CONNECTOR WITH LOW PROFILE TERMINAL

BACKGROUND OF THE INVENTION

1. Field of the Invention

The present invention relates to an electrical connector, especially to an electrical connector with low profile terminal array mounted to a printed circuit board and adapted for electrically connecting a semiconductor package.

2. Description of the Related Art

With development of technology, electrical connectors, which have land grid array (LGA) pins or solder balls, have widespread applications in computers and other electrical devices for transmitting signals and conductive current between a printed circuit board (PCB) and an IC package.

A traditional LGA electrical connector comprises a plastic housing (such as terminal carriers) and multiple metal copper alloy terminals. As people ask for more pin counts and smaller electrical connector in size, a design of a new type LGA electrical connector become more and more challenging due to a space required for terminal arms and an increasing loading force.

US Patent Application Publication No. 20090081891, published to IBM on Mar. 26, 2009 discloses a related land grid array (LGA) electrical connector. The land grid array (LGA) electrical connector comprises an insulating carrier plane and at least one interposer mounted on a first surface of said carrier plane. Said interposer selectively has a hemi-toroidal, conical, dome-shaped conic section, generally cylindrical or hemi-spherical configuration in transverse cross-section and is constituted of a dielectric elastomeric material. A plurality of electrically-conductive elements are arranged about the surface of said at least one hemi-toroidal interposer and extend radially inwardly and downwardly from an uppermost end thereof to electrically contact with an electrically conductive pad. The insulating carrier plane has at least one via formed therein. The electrically-conductive pad extend through said at least one via and has portions extending in surface contact with the upper surface of said insulating carrier plane. The electrically-conductive elements comprise metallic strips extending to contact with an upper surface of said pad. The interposers of essentially conical or dome-shaped conic sections are arranged in paired in groupings with a predetermined number of said interposers. In each said grouping, the electrically-conductive elements of each said interposers joint with proximate said at least one via in said insulating carrier plane and contact with said pad to form a common connection at a lower surface of said insulating carrier plane, and each of the interposers in one grouping differs in height from another interposers in another grouping.

However, the land grid array (LGA) electrical connector has a complex configure, that need more time to manufacture and assembly the land grid array (LGA) electrical connector, and that also means the product has a high cost.

Hence, an improved electrical connector is required to overcome the disadvantages of the prior art.

SUMMARY OF THE INVENTION

An object of the invention is to provide an electrical connector having a simple configure and a low load terminal for offering a better electrical connection.

To achieve the above-mentioned object, an electrical connector adapted for electrically connecting an IC package, comprises a base having a main body which defining a receiving space for the IC package and a plurality of passageways extending vertically the two opposed sides of the main body; and a plurality of terminals received in the base, and the terminal composed of an insulated elastomer acting as a resilient portion and a plurality of electrical elements assembled on the insulated elastomer acting as conductive portions to provide a plurality of electrical connecting path for connecting the IC package.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
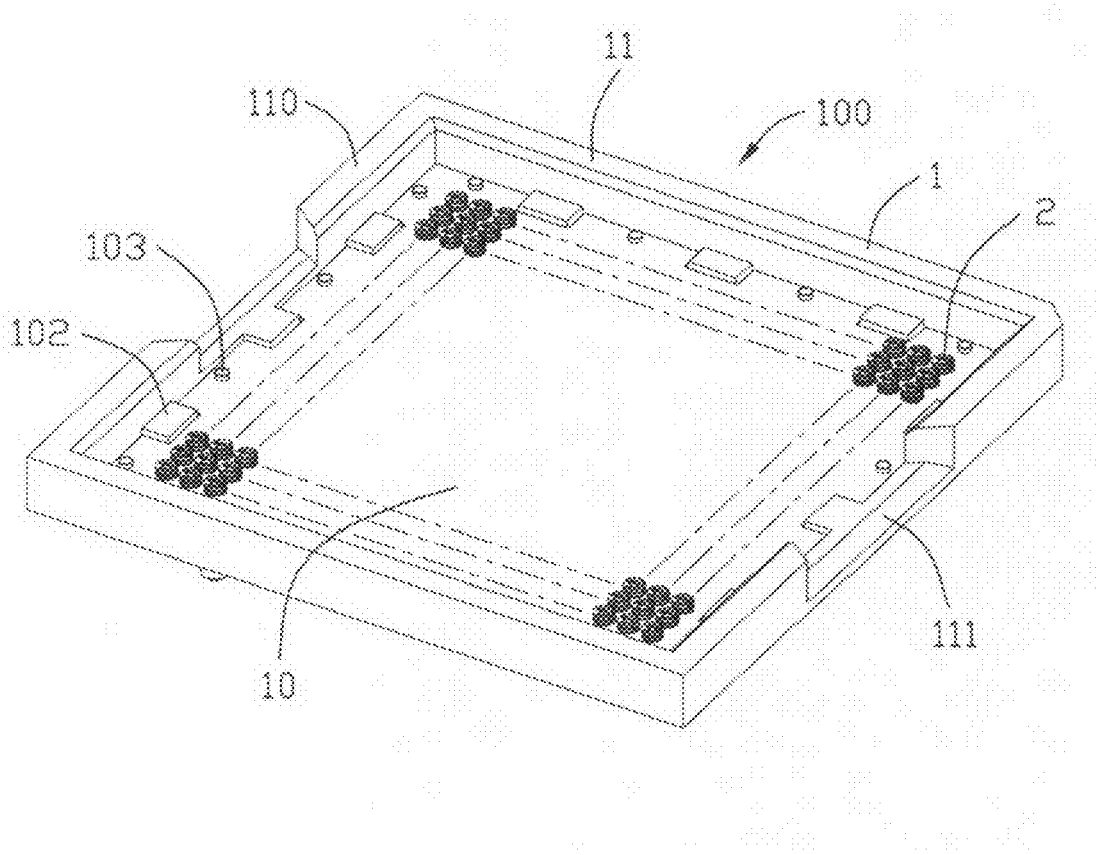
FIG. 1 is an assembled, perspective view of an electrical connector in accordance with a preferred embodiment of present invention.
Figure 2:
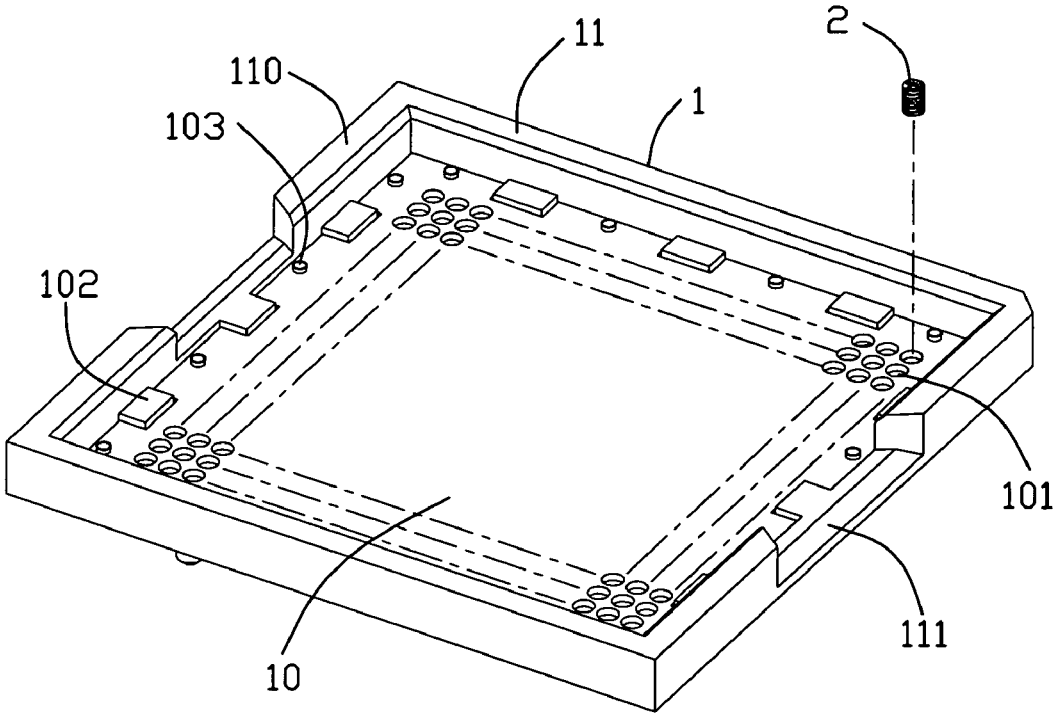
FIG. 2 is an exploded, perspective view of the electrical connector shown in FIG. 1.

Referring to FIGS. 1-2, an electrical connector 100 in accordance with a preferred embodiment of present invention is adapted for electrically connecting an IC package (not shown) to a printed circuit board (not shown). The electrical connector 100 comprises an insulative base 1 and a plurality of terminals 2 assembled in the insulative base 1.

Referring to FIG. 2, the insulative base 1 includes a rectangular main body 10, and four side walls 11 surrounding the main body 10. The surrounding side walls 11 extend over the main body 10. The main body 10 together with the surrounding side walls 11 defines a room for receiving an IC package (not shown) therein. The main body 10 defines a plurality of passageways 101 extending vertically therethrough and arranged in a rectangular array for receiving a corresponding number of terminals 2 therein. A plurality of supporting portions 102 extend upwardly from a top surface of the main body 10. The supporting portions 102 are located around the main body 10 and adjacent to the surrounding side walls 11. A number of projections 103 also extend from the top surface of the main body 10, and are located between two adjacent supporting portions 102. The supporting portions 102 and the projections 103 are together used for supporting the IC package (not shown) so as to avoid to destroy the terminals 2. A pair of gaps 111 are defined at a middle of two opposite side walls 110, respectively, for conveniently taking the IC package (not shown) out.

Figure 3:
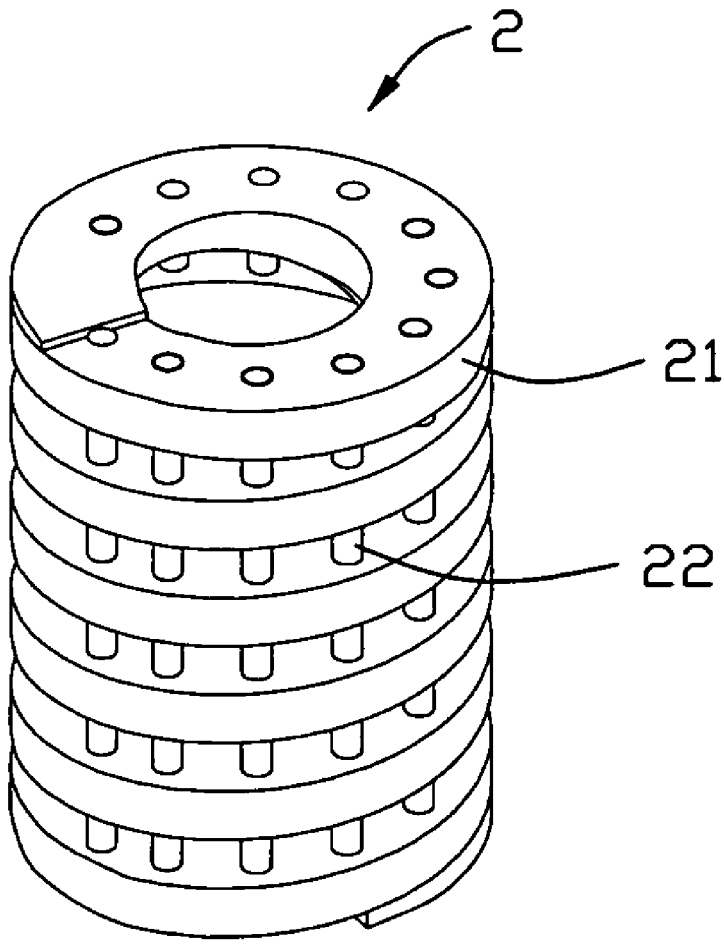
FIG. 3 is an assembled, perspective view of a terminal of the electrical connector in accordance with the preferred embodiment of present invention.
Figure 4:
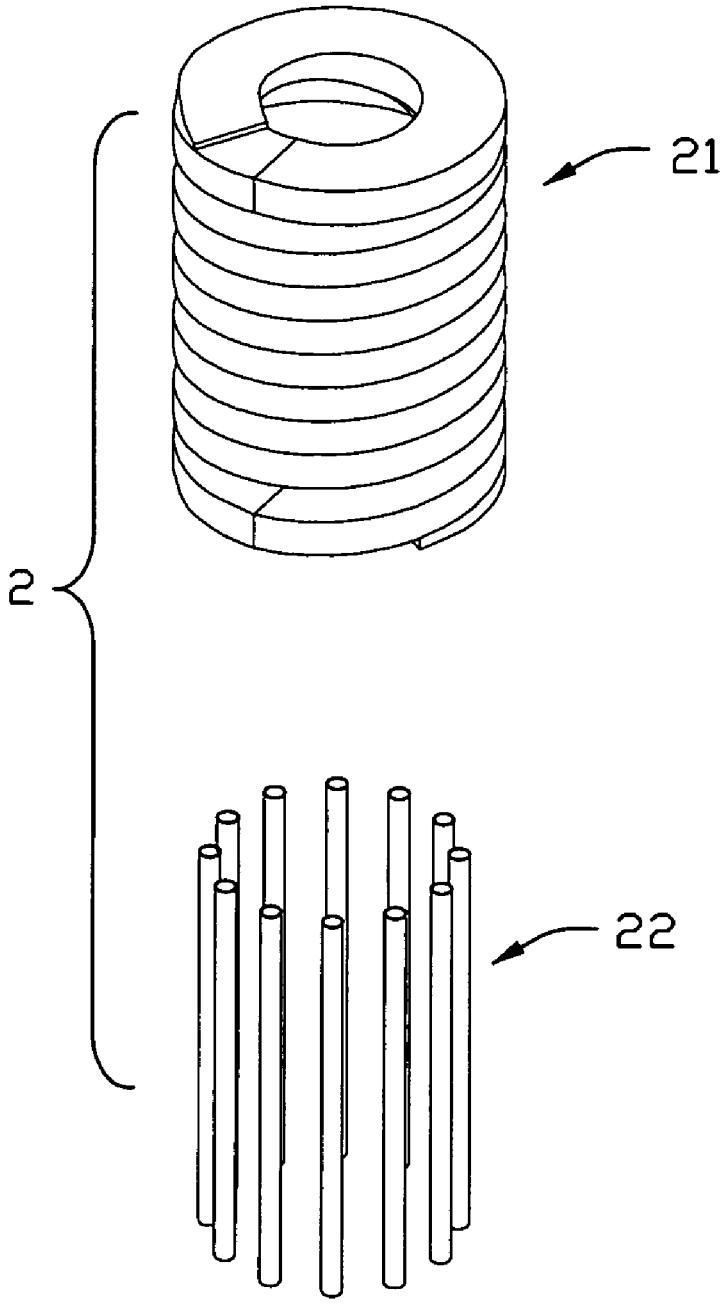
FIG. 4 is an exploded, perspective view of the terminal shown in FIG. 3.

Referring to FIG. 3, conjoining with FIG. 4, the terminal 2 is configured of an insulated elastomer 21 and a plurality of electrical elements 22 embedded in the insulated elastomer 21. The insulated elastomer 21 generally has a cylindrical configuration. The insulated elastomer 21 can provide the terminal 2 a better elasticity. The electrical elements 22 are made of copper alloy wires. The electrical elements 22 are parallel to each other in a vertical direction. The electrical elements 22 are arranged in a circular shape in the insulated elastomer 21. The terminal 2 having the plurality of electrical elements 22 can provide parallel electrical connection paths to reduce a resistance of the terminal 2.

Figure 5:
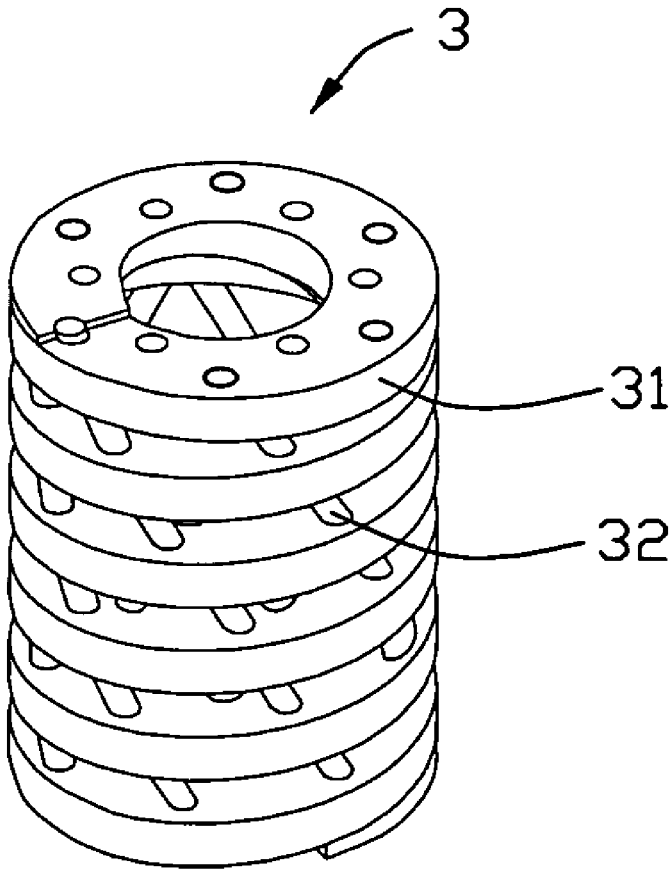
FIG. 5 is an assembled, perspective view of an alternative terminal of the electrical connector in accordance with the preferred embodiment of present invention.
Figure 6:
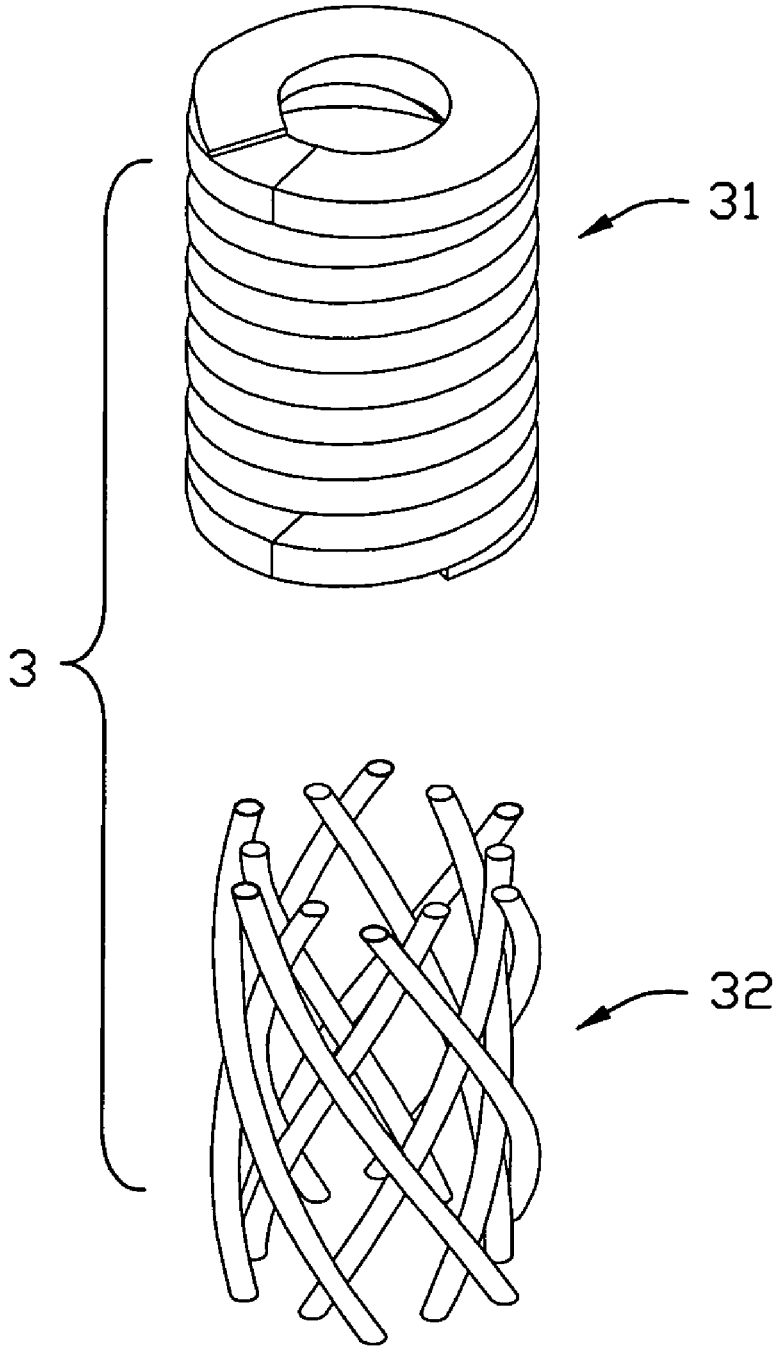
FIG. 6 is an exploded, perspective view of the terminal shown in FIG. 5.

FIG. 5 illustrates an alternative terminal 3 of the electrical connector 100 in accordance with the preferred embodiment of the present invention. Conjoining with FIG. 6, the terminal 3 also includes an insulated elastomer 31 embedded with a plurality of electrical elements 32. The electrical elements 32 are some copper alloy wires braided with each other. The electrical elements 32 are integrally molded in the insulated elastomer 31. The braided electrical elements 32 can provide multiple conductive paths so as to reduce a resistance of the terminal 3.

Figure 7:
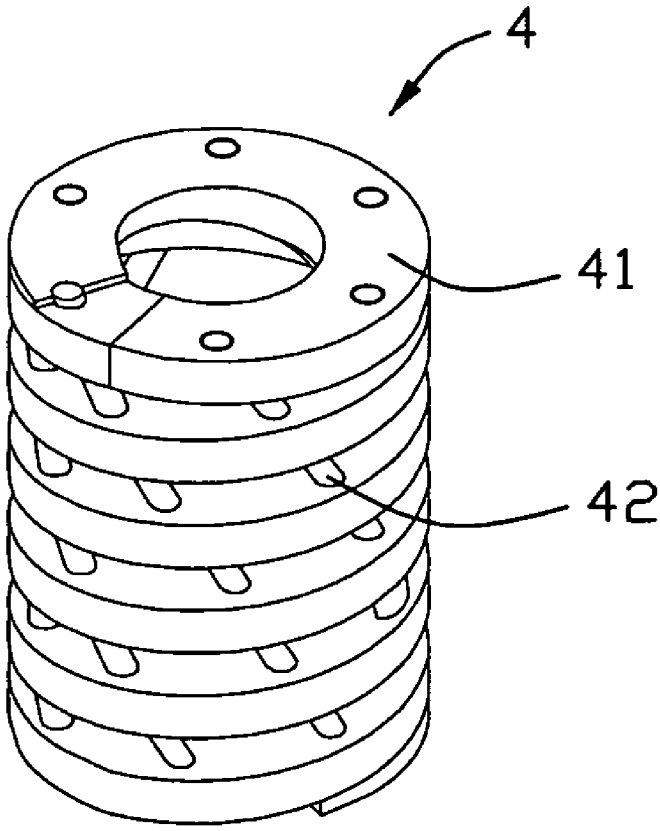
FIG. 7 is an assembled, perspective view of another alternative terminal of the electrical connector.
Figure 8:
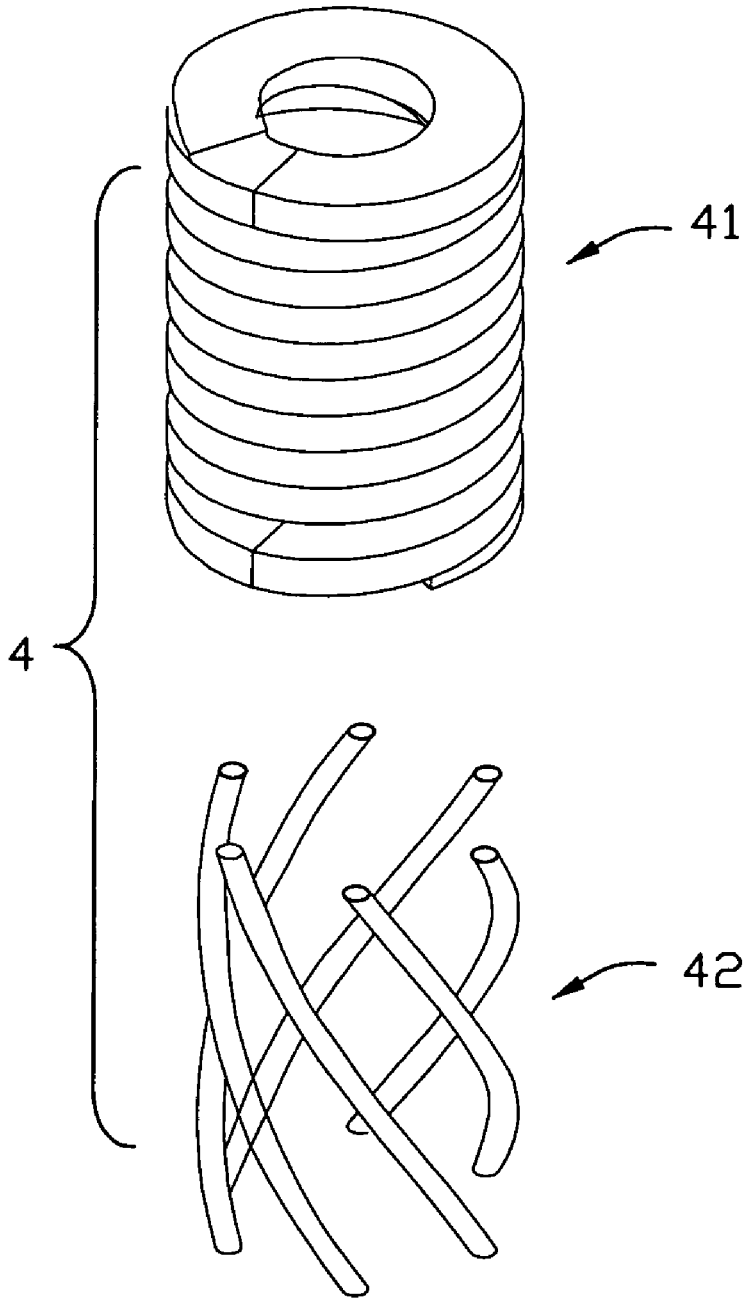
FIG. 8 is an exploded, perspective view of the terminal shown in FIG. 7.

FIG. 7 and FIG. 8 illustrate another alternative terminal 4. The terminal 4 also includes an insulated elastomer 41 embedded with a plurality of electrical elements 42. The electrical elements 42 are also made of copper alloy wires and are integrally molded in the insulated elastomer 41. The terminal 4 is different from the terminal 3, the copper alloy wires 42 are inclined but not braided molded in the insulated elastomer 41. The copper alloy wires 42 are homogeneous arranged to form a circular configure in the insulated elastomer 41.

Figure 9:
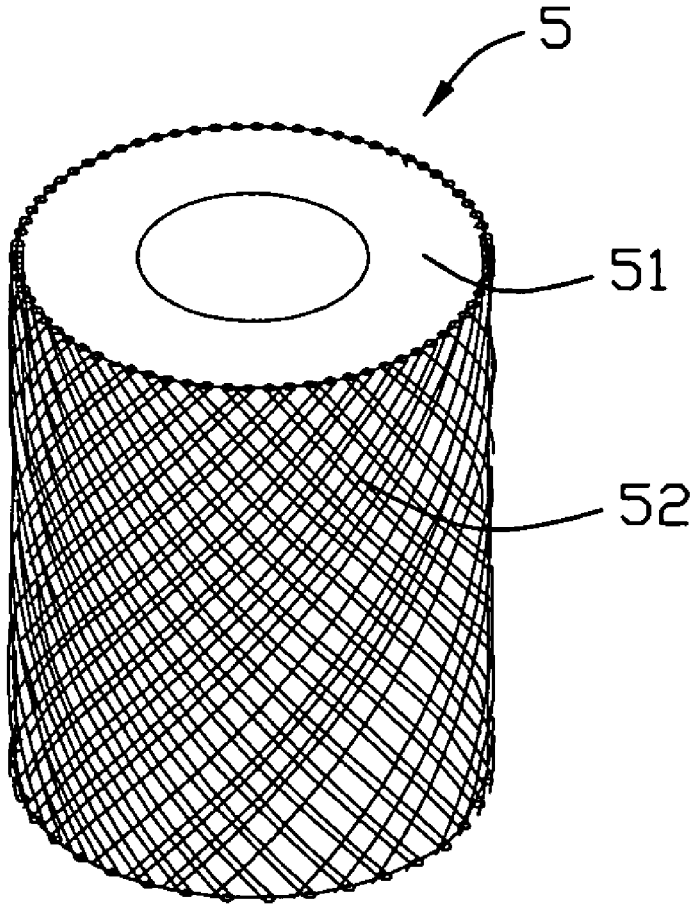
FIG. 9 is an assembled, perspective view of another alternative terminal of the electrical connector.
Figure 10:
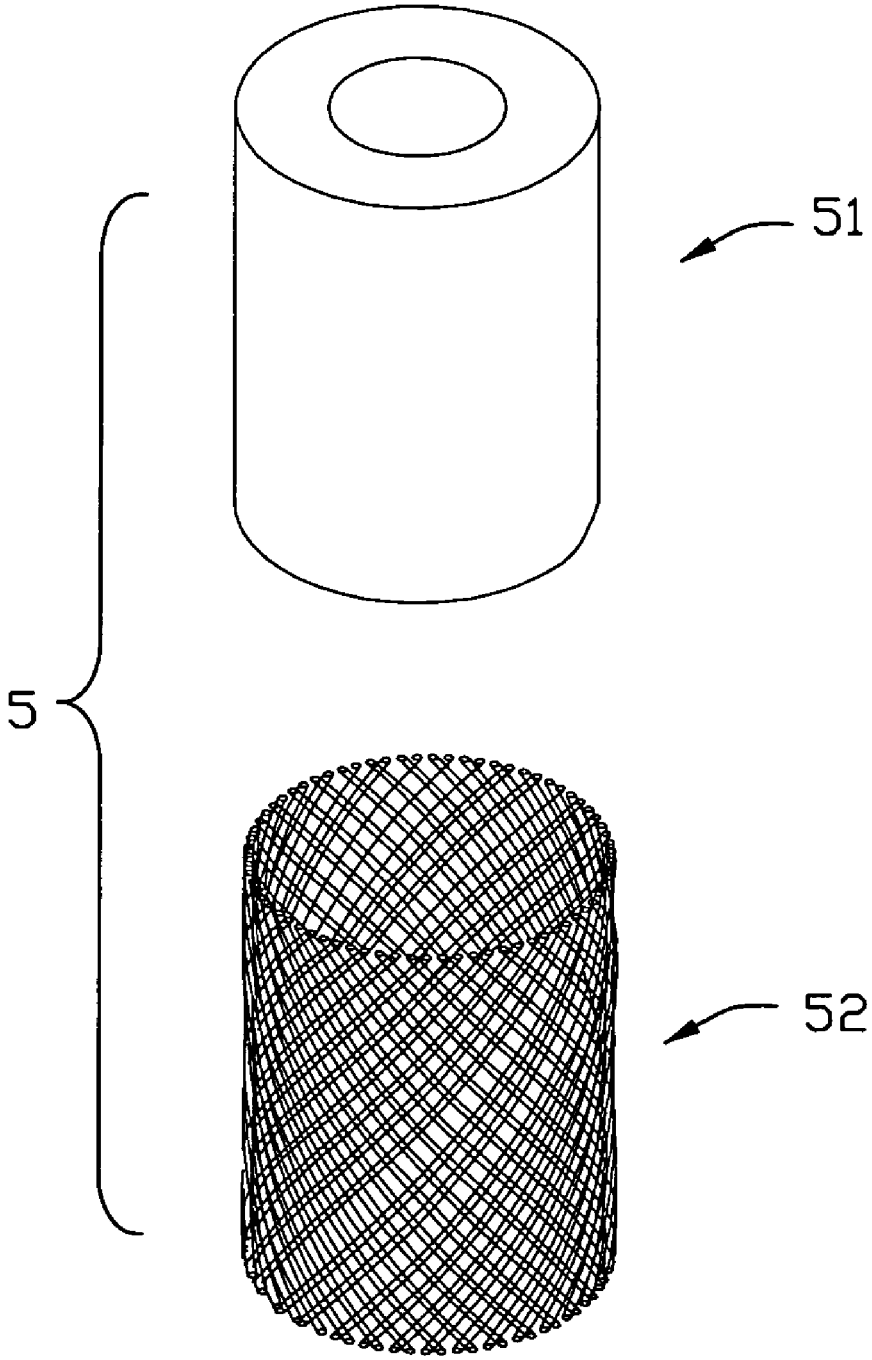
FIG. 10 is an exploded, perspective view of the terminal shown in FIG. 9.

FIG. 9 shows another alternative terminal 5 of the electrical connector 100. Conjoining with FIG. 10, the terminal 5 includes a cylindrical insulated elastomer 51 and an electrical element 52 set on a periphery of the cylindrical insulated elastomer 51. The electrical element 52 is a network structure which contains a plurality of copper alloy wires. The electrical element 52 is formed in a round tube-like configuration and enwraps the cylindrical insulated elastomer 51. The electrical element 52 has a same height as that of the cylindrical insulated elastomer 51.

In this invention, the terminal 2 is made with multiple materials, the insulated elastomers 21 (like 31, 41, and 51 etc.) is made by plastic, or other low stiffness material, and the electrical elements 2 can be made by multiple high conductivity material, such as copper alloy. The insulated elastomer 21, 31, 41, and 51 act as a resilient portions, and the terminal 22, 32, 42, and 52 act as conductive portions. The electrical connector 100 can not only provide a better elasticity but also can provide parallel electrical paths at the same time. Thus, the resistances of the terminal 22, 32, 42, and 52 can be reduced and the electrical connector 100 can realize a better electrical connection between the IC package (not shown) and the printed circuit board (not shown).

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector adapted for electrically connecting an IC package, comprising:

a base defining a receiving space for the IC package and having a plurality of passageways extending vertically through two opposed sides thereof; and a plurality of supporting portions extend upwardly from a top surface of the main body and is located around the main body and adjacent to the surrounding side walls;

a plurality of terminals received in the base, and the terminal formed with an insulated elastomer acting as a resilient portion and a plurality of electrical elements assembled on the insulated elastomer and acting as conductive portions to provide a plurality of electrical connecting paths for connecting with the IC package;

the insulated elastomer comprises a continues sheet wound in a helical configuration and the electrical elements are extending parallel to each other in an up and down direction through the continues sheets.

2. The electrical connector as described in claim 1, wherein the terminal includes an insulated elastomer and an electrical element setting around a periphery of the insulated elastomer.

3. The electrical connector as described in claim 2, wherein the electrical element is a network structure which contains a plurality of copper alloy wires.

4. The electrical connector as described in claim 3, wherein the electrical element is formed in a round tube-like configuration and enwraps the insulated elastomer.

5. The electrical connector as described in claim 1, wherein the base has a main body and four side walls extending over the main body and surrounding the main body to form the receiving space for the IC package.

6. The electrical connector as described in claim 5, wherein a pair of gaps are defined at the middle of the two opposite side walls for taking the IC package out.

7. The electrical connector as described in claim 5, wherein; the supporting portions and the projections are together used for supporting the IC package so as to avoid to destroy the terminals.

8. The electrical connector as described in claim 7, wherein a plurality of projections extend from the top surface of the main body and are located between the two adjacent supporting portions.

9. The electrical connector as described in claim 1, wherein the insulated elastomer is made of plastic, and the electrical elements are embedded in the insulated elastomer.

10. The electrical connector as described in claim 9, wherein the electrical elements are made of copper alloy wires.

11. The electrical connector as described in claim 9, wherein; the electrical elements are some copper alloy wires braided with each other.

12. The electrical connector as described in claim 9, wherein; the braided electrical elements can provide multiple conductive paths so as to reduce a resistance of the terminal.

13. The electrical connector as described in claim 9, wherein; the electrical element is enwraps the insulated elastomer.

14. The electrical connector as described in claim 9, wherein the electrical elements are integrally molded in the insulated elastomer.

15. The electrical connector as described in claim 9, wherein the electrical elements are made of copper alloy wires and incline in the insulated elastomer.

16. An electrical connector for use with an electronic package, comprising:

an insulative housing defining an mating upper face, for confrontation with the electronic package, with therein a plurality of passageways under said upper face; and a plurality of supporting portions extend upwardly from a top surface of the main body and is located around the main body and adjacent to the surrounding side walls;

a plurality of terminals disposed in the corresponding passageways, respectively, each of said terminals including an insulated elastomer piece associated with a conductor assembly; wherein said insulated elastomer piece is deformable/deflectable in a vertical direction and endures downward forces imposed thereupon by the electronic package, and said conductor assembly is essentially formed by a plurality of wires and complies with said insulated elastomer piece to be in a deformable/deflectable condition in said vertical direction, the insulated elastomer piece comprises a continues sheet wound in a helical configuration and the electrical elements are extending parallel to each other in an up and down direction through the continues sheets.

* * * * *